US005853825A

United States Patent [19]

Parsons

[11] Patent Number: 5,853,825

[45] Date of Patent: Dec. 29, 1998

[54] FREE FORM NUGGET AND METHOD OF CASTING

[76] Inventor: Donald Homer Parsons, 1003 NE. Lybarger, Olympia, Wash. 98501

[21] Appl. No.: 646,942

[22] Filed: May 8, 1996

[51] Int. Cl.[6] ..... B22D 25/02; B22D 29/00

[52] U.S. Cl. ..... 428/15; 428/544; 428/613; 164/132; 164/138

[58] Field of Search ..... 428/613, 544, 428/15; 164/132, 36, 138

[56] References Cited

U.S. PATENT DOCUMENTS

| | | | |
|---|---|---|---|
| 393,954 | 12/1888 | Woodward | 29/2 |
| 752,816 | 2/1904 | Bennett | 164/97 |
| 999,391 | 8/1911 | Mealy et al. | 29/896.41 |
| 3,138,857 | 6/1964 | Kuchek | 428/613 |
| 3,236,706 | 2/1966 | Kuchek | 164/36 |
| 3,407,864 | 10/1968 | Anderko et al. | 164/132 |
| 3,523,766 | 8/1970 | Markus et al. | 164/36 |
| 3,645,491 | 2/1972 | Brown et al. | 164/132 |
| 3,847,715 | 11/1974 | Goodspeed | 164/138 |
| 3,854,195 | 12/1974 | Landig | 164/138 |
| 4,250,950 | 2/1981 | Buxmann | 164/47 |
| 4,385,088 | 5/1983 | Baskin | 428/15 |
| 5,379,948 | 1/1995 | Teppo | 241/24 |

FOREIGN PATENT DOCUMENTS

| | | | |
|---|---|---|---|
| 42328 A1 | 12/1981 | European Pat. Off. | 164/132 |
| 1483641 | 2/1969 | Germany | 164/36 |

*Primary Examiner*—John J. Zimmerman
*Attorney, Agent, or Firm*—Brian J. Coyne

[57] ABSTRACT

A free-form metal casting that simulates a natural metal nugget, and method of casting the same. Molten metal is poured into a recess in an upper surface of a bed of rock salt. While still molten, portions of the metal variously penetrate downward through the rock salt, thereby forming, as the metal cools, a unique casting having a random pattern of stalagmite extensions. The surfaces of the casting have a pitted, grainy texture impressed by the rock salt, which simulates the appearance of naturally occurring precious metal nuggets. Surface metal oxides are removed from the casting by electrofinishing. Cast nuggets of copper, brass and bronze are preferably electroplated with gold or silver. After polishing, the cast nuggets are suitable for use in jewelry and decorative art objects.

17 Claims, 4 Drawing Sheets

FREE FORM NUGGET AND METHOD OF CASTING

BACKGROUND OF THE INVENTION

1. Field of the Invention.

The present invention relates to the field of free-form casting of metals, especially casting of precious metals for jewelry and decorative objects.

2. Prior Art.

Free-form metal castings are desirable in jewelry and in other decorative objects, both for their beauty and for their uniqueness. Unlike castings created by pouring molten metal into a fixed mold that produces identical castings, each free-form metal casting has a unique, three-dimensional shape. It is especially desired to be able to create simulated nuggets of gold, silver and other precious metals for these purposes that appear natural rather than artificial.

Goodspeed, U.S. Pat. No. 3,847,715, and Landig, U.S. Pat. No. 3,854,195, disclosed a free-form method of casting metals comprising rapidly pouring molten metal of a controlled temperature onto a bed of chunks of ice. In their method, the metal quickly ran down between the chunks of ice in a random manner, partially melting the ice chunks before the metal solidified, thereby creating a casting having a random pattern of stalagmite extensions. The castings created by their method each had a unique appearance and were substantially free of sharp protrusions. Such castings were not realistic simulations of natural metal nuggets, however, because the castings' surfaces lacked the grainy, uneven texture found in natural nuggets of gold, silver and other precious metals.

There remains, therefore, a need for a method of free-form casting of metal nuggets that simulates the nuggets found in nature.

SUMMARY OF THE INVENTION

According to the invention, a method of making natural-appearing metal nuggets for use in jewelry and art objects comprises pouring a quantity of molten metal into a depression formed in an upper surface of a bed of rock salt. The casting is removed from the bed of rock salt, and clinging grains of rock salt are washed off the surfaces of the casting. In a preferred embodiment, when the casting consists of either silver or gold, the casting is next eletrofinished to remove surface oxides, which improves the appearance of the casting. In the case of non-ferrous castings, such as copper, brass or bronze, the casting may be electroplated with silver or gold.

Further according to the invention, an artificial metal nugget for use in jewelry and art objects, comprises a metal casting having a random pattern of stalagmite extensions formed by pouring a quantity of molten metal into a depression in an upper surface of a bed of rock salt, the rock salt impressing a grainy texture on the surfaces of the casting, such that the casting well simulates naturally-occurring metal nuggets, for example, gold nuggets and silver nuggets.

DETAILED DESCRIPTION OF THE INVENTION

Figure 1:
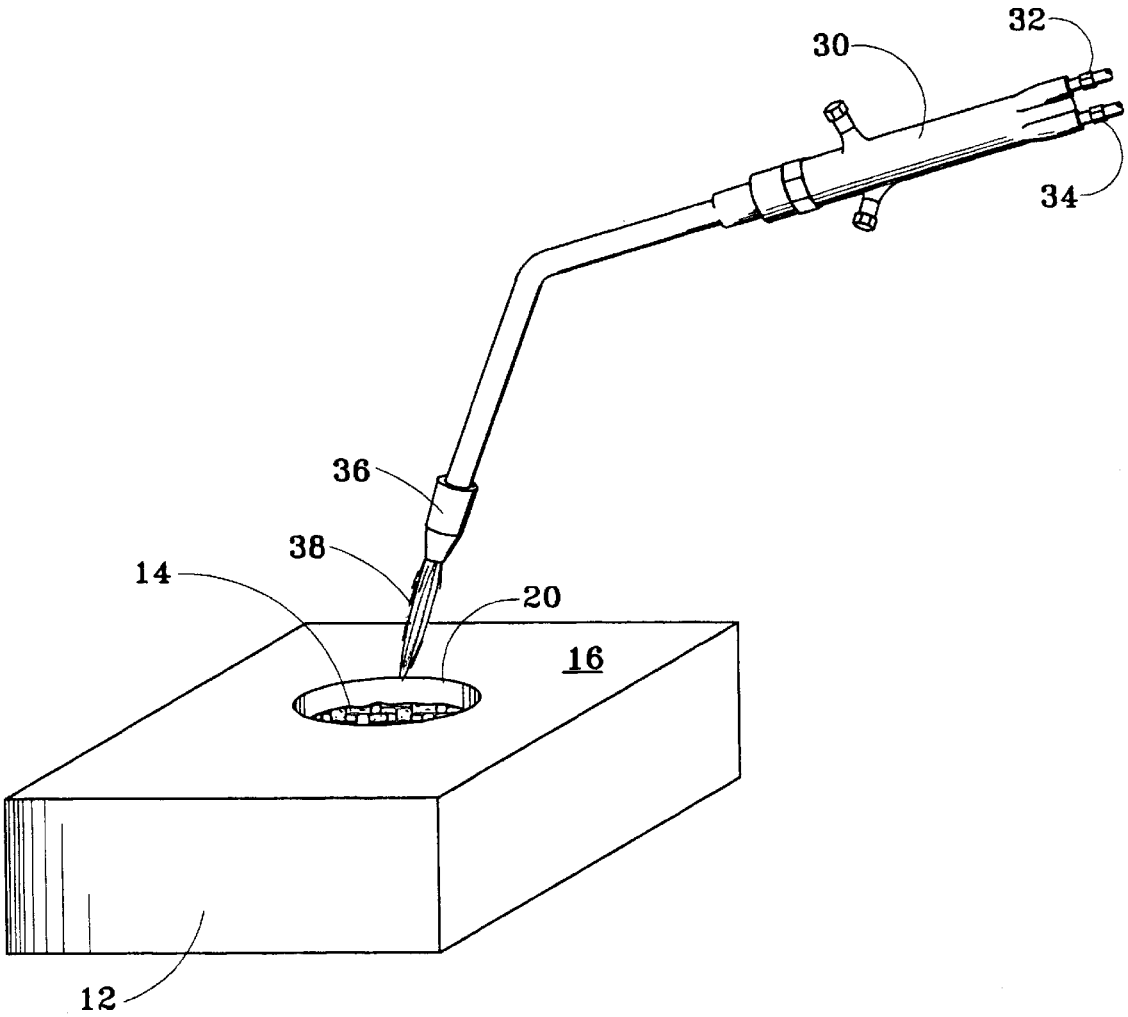
FIG. 1 is a perspective view of metal in an open container being heated to melting temperature by a casting torch.

Referring now to FIG. 1, an open container 12 for supporting and containing metal 14 intended for casting is shown. In a preferred embodiment of the invention, the container 12 is a charcoal soldering block of the type commonly used for supporting metal jewelry during soldering operations. A convenient size charcoal solder block for practicing the method of the invention is 3 ½ inches by 2 ½ inches by 1 ½ inches, but larger and smaller blocks may also be used. A recess 20 is cut out of an upper surface 16 of the block 12. Preferably, the recess is cylindrical, with diameter one inch and depth one-half inch, more or less.

The metal 14 may be gold, silver, or a non-ferrous metal chosen from one of copper, brass or bronze. If the metal 14 is gold, it should be at least 6-karat and not more than 18-karat gold. Gold may be conveniently placed into the recess 20 in the form of gold pennyweight flakes. One pennyweight of gold suffices for a casting for an earring; four pennyweights of gold suffices for a casting for a pendant or broach.

Also shown in FIG. 1 is a casting torch 30 suitable for melting gold, silver and other casting metals and having a first inlet port 32 for oxygen and a second inlet port 34 for acetylene, hydrogen or natural gas. The tip 36 of the torch 30 is held near the metal 14 and aimed so that the flame 38 heats the metal 14 to melting temperature or above.

Figure 2:
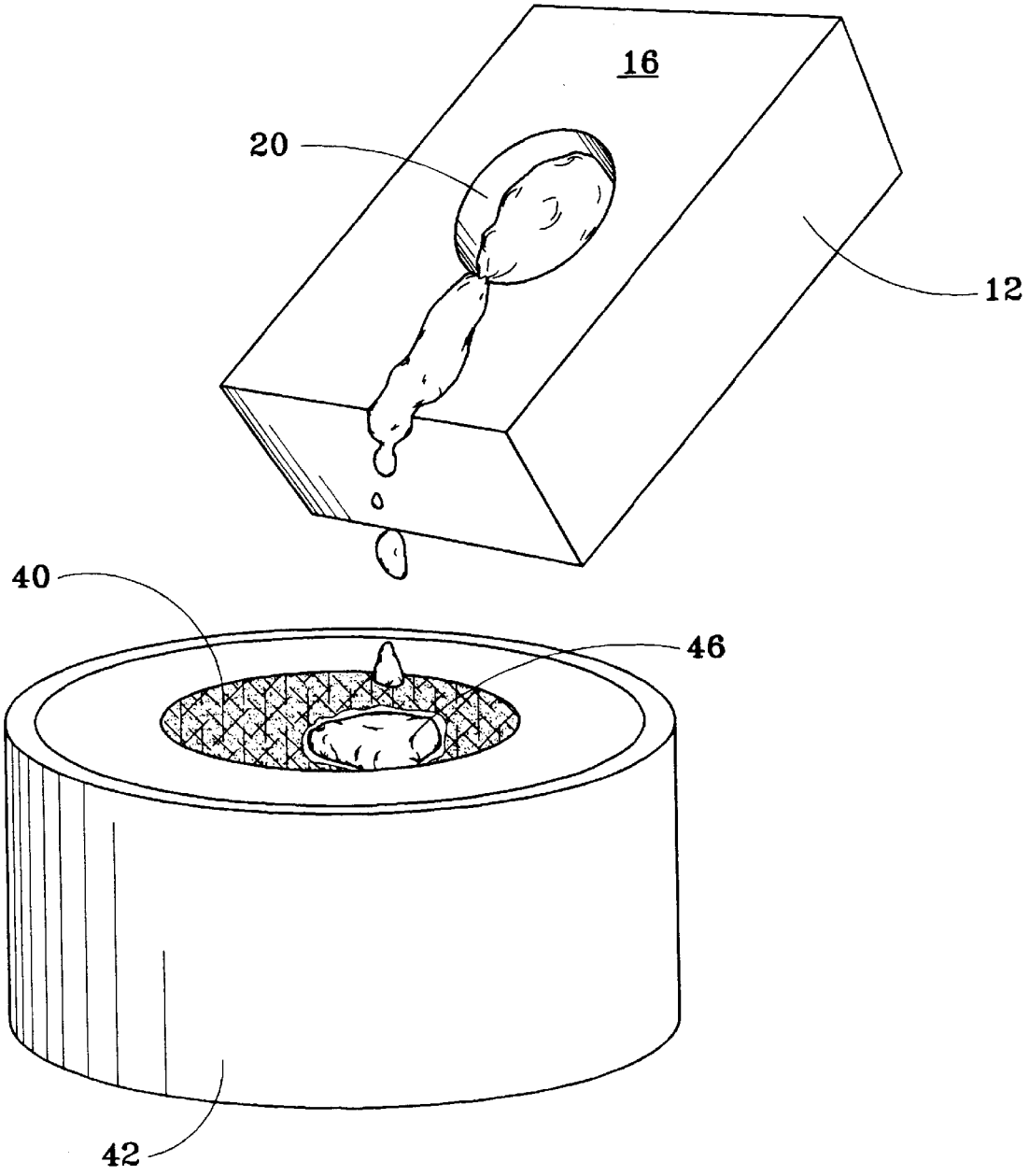
FIG. 2 is a perspective view of molten metal being poured from the open container onto an upper surface of a bed of rock salt.

Referring now to FIG. 2, a bed of rock salt 40 is shown placed into a cannister 42, for example, a cylindrical metal cannister open at the top, closed at the bottom, having diameter three inches and height 1 ½ inches. For safety and stability, the cannister 42 preferably rests on a horizontal workbench or table top (not shown). A depression 46 is formed in an upper surface of the rock salt 40. Once the metal 14 has been melted, the container 12 is held over the cannister 42 and the molten metal 42 is rapidly poured from the container 12 into the depression 46 in the rock salt 40. Portions of the molten metal 14 inside the depression 46 variously penetrate downward into the rock salt 40, thereby forming, as the metal cools, a casting 70 having a random pattern of stalagmites 62 that extend down from a metal base 60 formed within the depression 46. The casting 70 is thereafter removed from the rock salt 40 and washed to remove clinging particles and grains of rock salt. The washing is preferably done by placing the casting 70 into a bath of clean water (not shown) at or near room temperature. Shown in FIG. 3 in perspective view, three times enlarged, is a typical casting 70 prepared according to the method of the invention, inverted and oriented to show stalagmites 62 projecting upward from a base 60 below. The same casting 70 is shown in FIG. 4 as seen from the left side of FIG. 3. As FIG. 4 shows in side elevation, a typical such casting 70 has a substantially flat base 60, in contrast to the opposite, stalagmite-littered face of the casting 70 as shown in FIG. 3.

Figure 3:
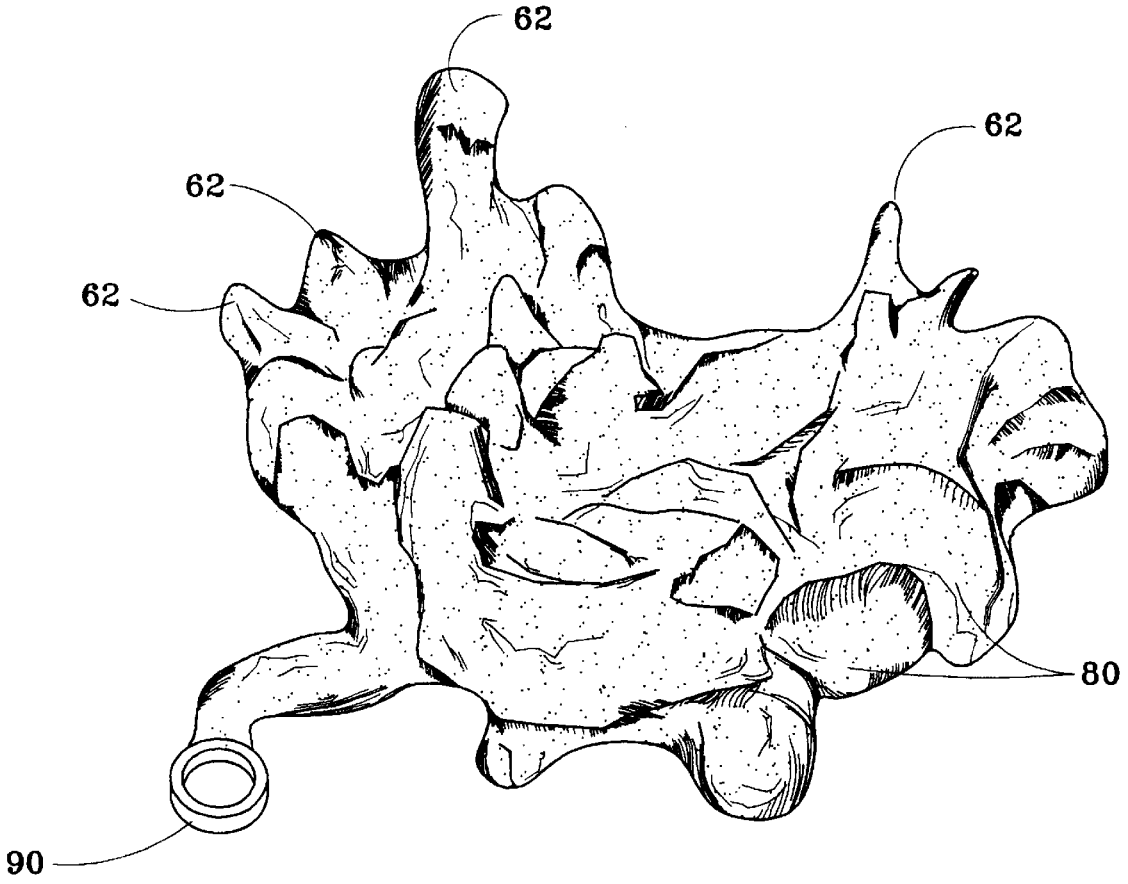
FIG. 3 is an enlarged, perspective view of a typical metal nugget cast according to the method of the invention for use in a jewelry pin or broach.
Figure 4:
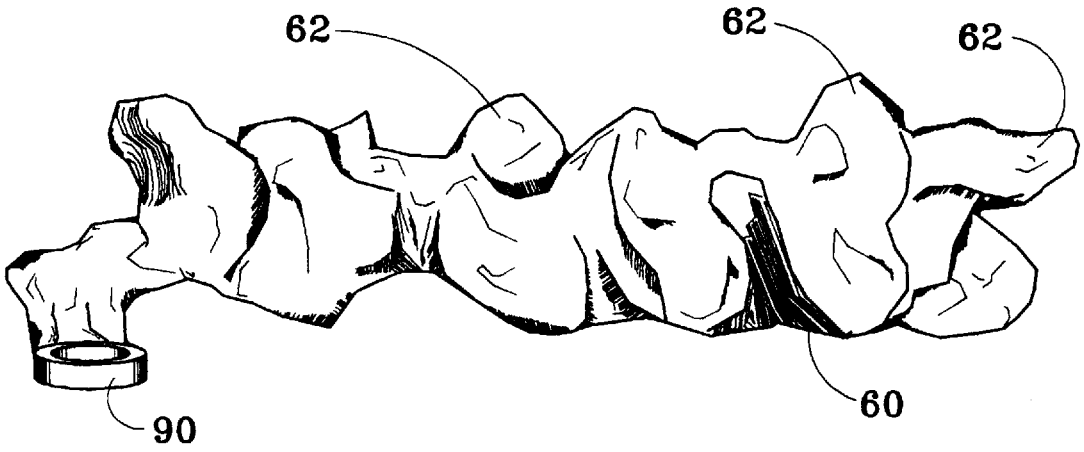
FIG. 4 is a side elevational view of the nugget of FIG. 3.

The surfaces of the typical casting 70 are heavily pitted and everywhere irregular due to the impression of the rock salt, as depicted by the stippling 80 in FIG. 3, so that the casting 70 well simulates a natural metal nugget. Even so, there are few or no sharp projections on a typical casting 70. Rock salt suitable for this method of casting is available from Morton Salt Company of Chicago, Ill. and has grains with major dimension predominantly in the range 2 to 6 mm.

To remove surface metal oxides from a gold or silver casting 70, the casting is preferably subjected to electrofinishing according to methods well known to those skilled in the art. Suitable electrofinishing equipment for this purpose is available, for example, from Sweat, Inc., of Los Angeles, Calif. an effective electro-stripper solution for use in electrofinishing is available from Grobet Company of Carlstadt, N.J.

The appearance of castings made of non-ferrous metals such as copper, brass or bronze can be improved by electroplating them with gold or silver. Suitable electroplating equipment for this purpose is available, for example, from Grobet Company.

The appearance of each casting can be further improved by polishing with metal polishes known to persons of ordinary skill in the art, for example, 'TRIPOLI,' 'WHITE ROUGE,' and 'RED ROUGE' brand polishes available from the 3M Company of Minneapolis, Minn.

As shown in FIGS. 3 and 4, a jump ring 90 may be attached to the casting 70, either by soldering or by fusion welding. The jump ring 90 can serve as a point of attachment of the casting 70 to a pendant chain or other jewelry.

It will be appreciated that various modifications can be made to the exact form of the present invention without departing from the scope thereof. It is accordingly intended that the disclosure be taken as illustrative only and not limiting in scope.

I claim:

1. A method for casting free-form metal nuggets comprising:

a. placing rock salt inside an open cannister;

b. forming a depression in an upper surface of the rock salt;

c. pouring molten metal into the depression;

d. permitting the metal to cool to form a solid metal nugget;

e. removing the nugget from the cannister; and f. washing the rock salt away from the surface of the nugget.

2. The method of claim 1 wherein the molten metal is prepared by placing the metal into a recess in an upper surface of a charcoal solder block and heating the metal with a gas torch.

3. The method of claim 1 wherein the metal is at least 6-karat and not more than 18-karat gold.

4. The method of claim 1 wherein the metal is silver.

5. The method of claim 1 further comprising electrofinishing the nugget.

6. The method of claim 1 wherein washing the rock salt away from the surface of the nugget is accomplished by placing the nugget in a water bath.

7. The method of claim 1 wherein the metal is heated to melting temperature only.

8. The method of claim 1 wherein the metal is heated to a temperature greater than melting temperature.

9. The method of claim 1, wherein the metal is non-ferrous metal chosen from copper, brass or bronze.

10. The method of claim 9 further comprising electroplating the nugget.

11. A free-form metal nugget manufactured by placing rock salt inside an open cannister, forming a depression in an upper surface of the rock salt, pouring molten metal into the depression, permitting the metal to cool to form a solid metal nugget, removing the nugget from the cannister, and washing the rock salt away from the surface of the nugget.

12. The nugget of claim 11 wherein the metal is at least 6-karat and not more than 18-karat gold.

13. The nugget of claim 11 wherein the metal is silver.

14. The nugget of claim 12 wherein the surface thereof is electrofinished.

15. The nugget of claim 13 wherein the surface thereof is eletrofinished.

16. The nugget of claim 11 wherein the metal is a non-ferrous metal chosen from copper, brass or bronze.

17. The nugget of claim 16 wherein the surface thereof is electroplated with gold.

* * * * *